US011761333B2

(12) United States Patent
Niederriter et al.

(10) Patent No.: US 11,761,333 B2
(45) Date of Patent: Sep. 19, 2023

(54) CUTTING ASSEMBLY FOR LONGWALL MINING SYSTEM

(71) Applicant: Joy Global Underground Mining LLC, Warrendale, PA (US)

(72) Inventors: Edward Niederriter, Fryburg, PA (US); Ryan Dickey, Grove City, PA (US)

(73) Assignee: Joy Global Underground Mining LLC, Warrendale, PA (US)

( * ) Notice: Subject to any disclaimer, the term of this patent is extended or adjusted under 35 U.S.C. 154(b) by 118 days.

(21) Appl. No.: 17/525,362

(22) Filed: Nov. 12, 2021

(65) Prior Publication Data

US 2022/0154576 A1 May 19, 2022

Related U.S. Application Data

(60) Provisional application No. 63/114,227, filed on Nov. 16, 2020.

(51) Int. Cl.
*E21C 31/10* (2006.01)
*E21C 27/02* (2006.01)

(52) U.S. Cl.
CPC ..... *E21C 31/10* (2013.01); *E21C 27/02* (2013.01)

(58) Field of Classification Search
CPC ..... E21C 27/02; E21C 31/10; E21C 31/08
See application file for complete search history.

(56) References Cited

U.S. PATENT DOCUMENTS 2,721,733 A 10/1955 Driehaus
3,219,389 A 11/1965 Willy
3,290,096 A 12/1966 Stalker
3,424,499 A 1/1969 Webster
3,954,299 A * 5/1976 Hartley ..... E21C 35/12 299/1.6
4,047,763 A 9/1977 Gilliland et al.
4,172,616 A 10/1979 Delli-gatti, Jr.
4,223,950 A * 9/1980 Barr ..... E21C 35/00 299/42

(Continued)

FOREIGN PATENT DOCUMENTS

CN 202381091 U 8/2012
CN 106223946 A 12/2016

(Continued)

OTHER PUBLICATIONS

International Search Report and Written Opinion for Application No. PCT/US2021/059355 dated Feb. 11, 2022 (21 pages).

*Primary Examiner* — Janine M Kreck

(74) *Attorney, Agent, or Firm* — Husch Blackwell LLP

(57) ABSTRACT

A cutting assembly is configured to be coupled to a chassis of a mining machine. The cutting assembly includes a ranging arm configured to pivot about a pivot axis relative to the chassis, a motor supported by the ranging arm for the motor to move with the ranging arm about the pivot axis, and a drum including a plurality of cutting picks. The drum is supported by the ranging arm to be driven about a rotational axis by the motor. The cutting assembly includes a pitch adjustment actuator coupled to the ranging arm. The pitch adjustment actuator is operable to move the drum about a pitch axis. The pitch axis extends in a direction between the pivot axis and the rotational axis.

20 Claims, 10 Drawing Sheets

(56) References Cited

U.S. PATENT DOCUMENTS

| | | | |
|---|---|---|---|
| 4,303,277 | A | 12/1981 | Roepke et al. |
| 4,317,594 | A | 3/1982 | Unger |
| 4,328,996 | A | 5/1982 | Jahn |
| 6,158,818 | A | 12/2000 | Schaeff et al. |
| 6,315,365 | B1 | 11/2001 | Gerer et al. |
| 6,626,500 | B1 | 9/2003 | Cribb et al. |
| 7,909,275 | B2 | 3/2011 | Gross et al. |
| 8,608,250 | B2 | 12/2013 | O'Neill |
| 9,068,453 | B2 | 6/2015 | Rohwer et al. |
| 9,920,624 | B2 | 3/2018 | Doheny, II et al. |
| 10,036,248 | B2 | 7/2018 | Defibaugh et al. |
| 10,214,360 | B1 | 2/2019 | Rimmington |
| RE47,498 | E | 7/2019 | Niederriter et al. |
| 2011/0156470 | A1 | 6/2011 | Zimmerman et al. |
| 2014/0265528 | A1 | 9/2014 | O'Neill |
| 2015/0204190 | A1 | 7/2015 | Krings et al. |
| 2018/0171796 | A1 | 6/2018 | Moberg et al. |
| 2018/0298753 | A1 | 10/2018 | Moberg et al. |
| 2020/0032824 | A1 | 1/2020 | Niederriter et al. |

FOREIGN PATENT DOCUMENTS

| | | | | | |
|---|---|---|---|---|---|
| CN | 107654229 | A | | 2/2018 | |
| GB | 1215189 | A | * | 12/1970 | |
| GB | 2233362 | A | * | 1/1991 | ..... E21C 27/02 |

* cited by examiner

CUTTING ASSEMBLY FOR LONGWALL MINING SYSTEM

CROSS-REFERENCE TO RELATED APPLICATION

This application claims the benefit of U.S. Provisional Patent Application No. 63/114,227 filed Nov. 16, 2020, the contents of which are incorporated herein by reference.

TECHNICAL FIELD

The present disclosure relates to longwall mining systems, and particularly to cutting assemblies for a longwall mining system.

SUMMARY

Mining systems, such as longwall mining systems, include one or more ranging arms having cutting drums for cutting material from a mine face. In some embodiments, the material is deposited on an armored face conveyor (AFC) and carried away from the mine face.

In one aspect, a cutting assembly is configured to be coupled to a chassis of a mining machine. The cutting assembly includes a ranging arm configured to pivot about a pivot axis relative to the chassis, a motor supported by the ranging arm for the motor to move with the ranging arm about the pivot axis, and a drum including a plurality of cutting picks. The drum is supported by the ranging arm to be driven about a rotational axis by the motor. The cutting assembly includes a pitch adjustment actuator coupled to the ranging arm. The pitch adjustment actuator is operable to move the drum about a pitch axis. The pitch axis extends in a direction between the pivot axis and the rotational axis.

In another aspect, a cutting assembly is configured to be coupled to a chassis of a mining machine. The mining machine is configured to move in a direction relative to a mining wall. The cutting assembly includes a ranging arm having an upper surface and a lower surface opposite the upper surface. The ranging arm is configured to pivot about a pivot axis relative to the chassis. The cutting assembly includes a motor supported by the ranging arm and a drum including a plurality of cutting picks. The drum includes a first portion positioned above the upper surface of the ranging arm and a second portion positioned below the lower surface of the ranging arm. The drum is supported by the ranging arm to be driven about a rotational axis by the motor. The cutting assembly includes a pitch adjustment actuator configured to be coupled between the ranging arm and the chassis. The pitch adjustment actuator is configured to move the drum about a pitch axis such that the first portion of the drum moves toward the mining wall and the second portion of the drum moves away from the mining wall. The pitch adjustment actuator is also configured to move the drum about the pitch axis such that the first portion of the drum moves away from the mining wall and the second portion of the drum moves toward the mining wall.

In yet another aspect, a mining machine includes a chassis including a first end portion and a second end portion. The chassis is configured to tram in a direction extending between the first end portion and the second end portion. The mining machine includes a first cutting assembly coupled to the first end portion of the chassis. The first cutting assembly includes a first ranging arm pivotable about a first pivot axis relative to the chassis, a first motor supported by the first ranging arm for the first motor to move with the first ranging arm about the first pivot axis, and a first drum including a plurality of first cutting picks. The first drum is supported by the first ranging arm to be driven about a first rotational axis by the first motor. The first cutting assembly includes a first pitch adjustment actuator coupled between the first ranging arm and the first end portion of the chassis. The first pitch adjustment actuator is operable to move the first drum about a first pitch axis. The first pitch axis extends in a direction between the first pivot axis and the first rotational axis. The mining machine includes a second cutting assembly coupled to the second end portion of the chassis. The second cutting assembly includes a second ranging arm pivotable about a second pivot axis relative to the chassis, a second motor supported by the second ranging arm for the second motor to move with the second ranging arm about the second pivot axis, and a second drum including a plurality of second cutting picks. The second drum is supported by the second ranging arm to be driven about a second rotational axis by the second motor. The second cutting assembly includes a second pitch adjustment actuator coupled between the second ranging arm and the second end portion of the chassis. The second pitch adjustment actuator is operable to move the second drum about a second pitch axis. The second pitch axis extends in a direction between the second pivot axis and the second rotational axis.

Other aspects will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of supporting other embodiments and being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings. Terms of degree, such as "substantially," "about," "approximately," etc. are understood by those of ordinary skill to refer to reasonable ranges outside of the given value, for example, general tolerances associated with manufacturing, assembly, and use of the described embodiments.

Figure 1:
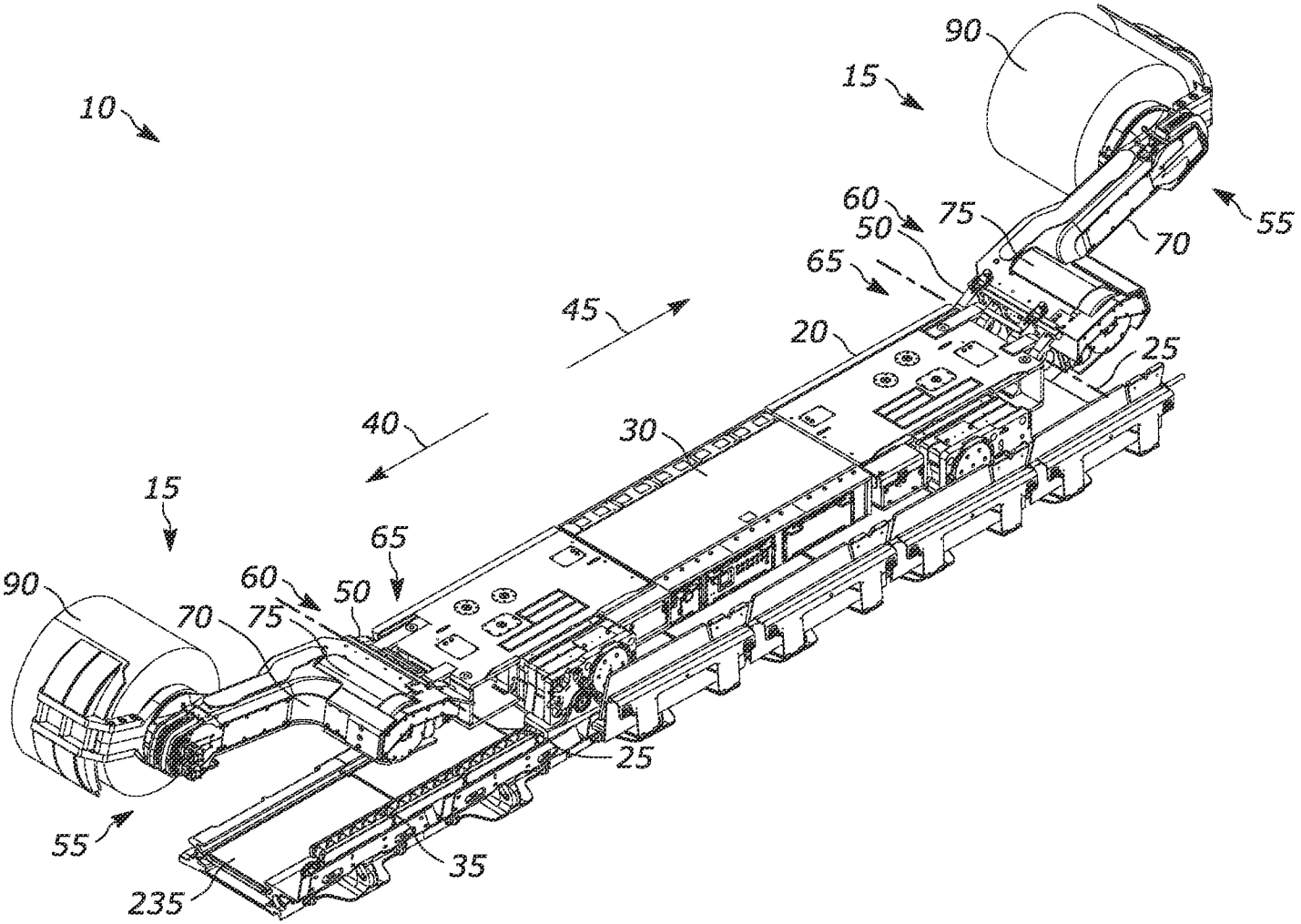
FIG. 1 is a perspective view of a mining machine including cutting assemblies.

FIG. 1 illustrates a mining machine, such as a longwall shearer 10, including a pair of cutting assemblies 15 each pivotably coupled to a frame or chassis 20 about a first pivot axis 25. The chassis 20 includes a power unit 30 (e.g., electrical power unit, hydraulic power unit, combination of electrical and hydraulic power unit, etc.) operable to move or tram the shearer 10 along a track 35 in a first direction 40 or a second direction 45 opposite the first direction 40.

Figure 2:
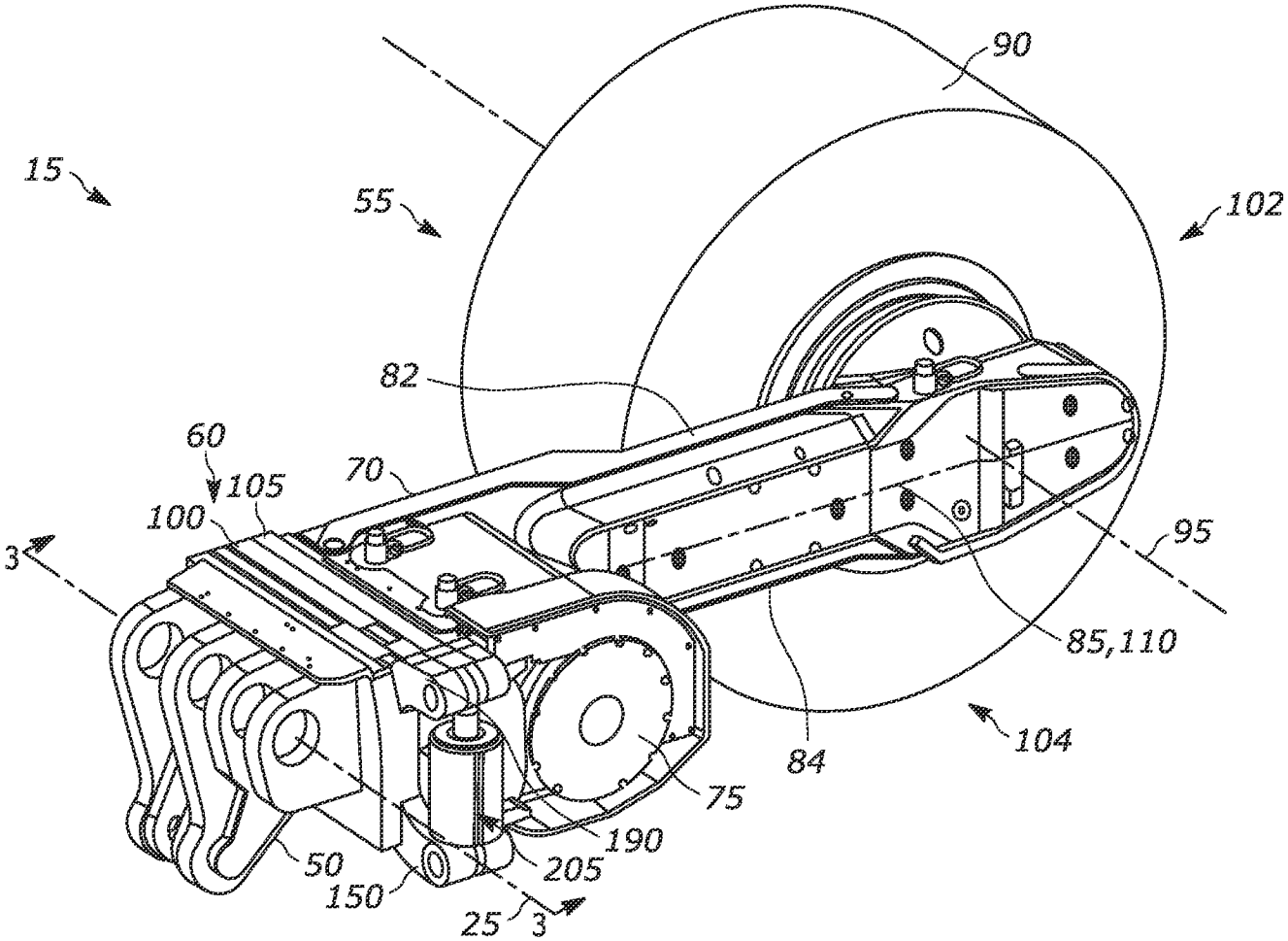
FIG. 2 is a perspective view of a cutting assembly according to one embodiment.

FIG. 2 illustrates one cutting assembly 15. It is understood that the other cutting assembly 15 may include similar components. The illustrated cutting assembly 15 includes a chassis mount 50, a ranging arm assembly 55, and a pitch adjustment system 60 (e.g., pitch adjustment actuator) coupled between the chassis mount 50 and the ranging arm assembly 55. The chassis mount 50 is pivotably coupled to an end portion 65 (FIG. 1) of the chassis 20 about the first axis 25. A hydraulic actuator (not shown), which is powered by the power unit 30, is coupled to the chassis 20 and the chassis mount 50 and operable to pivot the cutting assembly 15 about the first axis 25.

Figure 3:
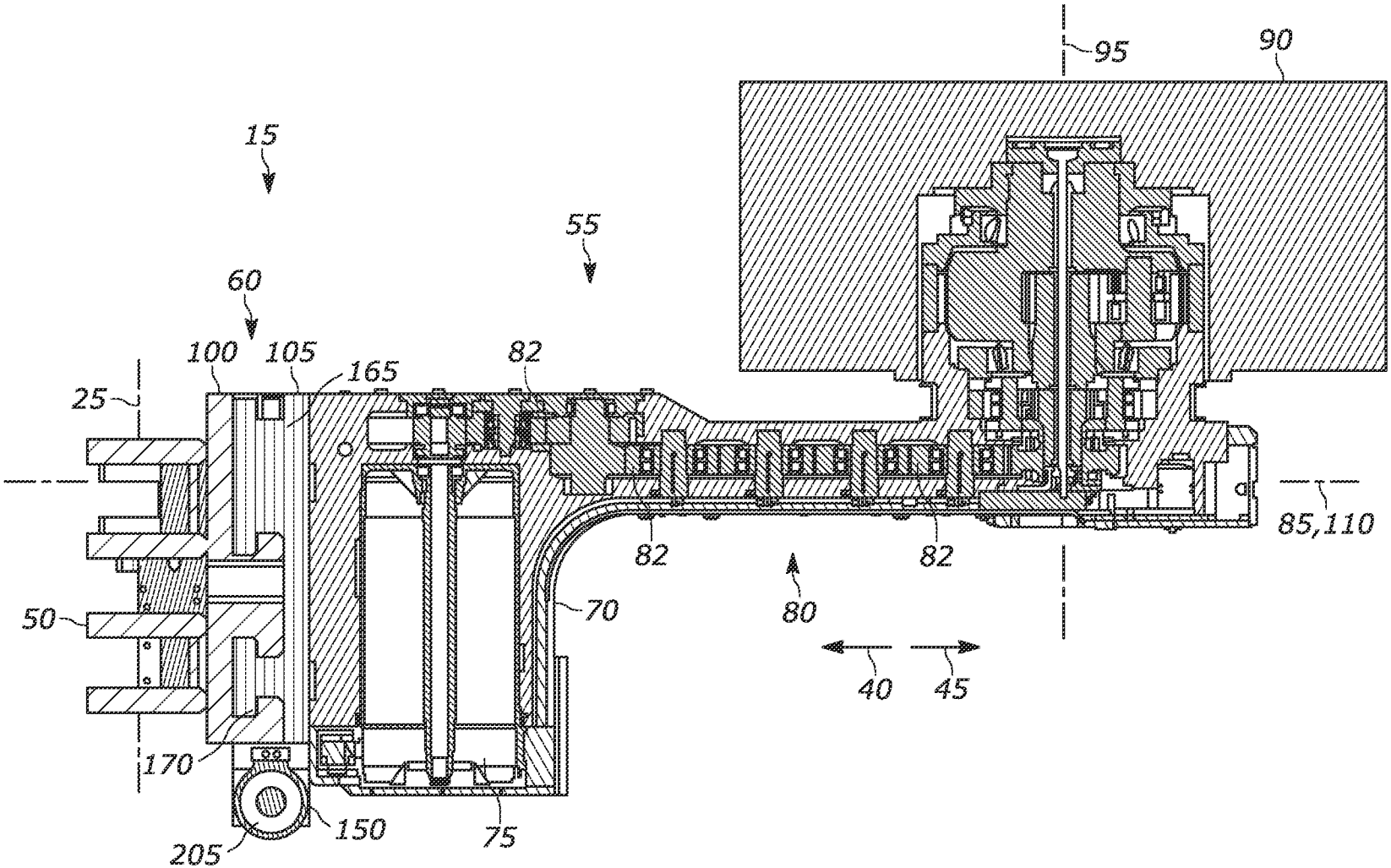
FIG. 3 is a cross sectional view of the cutting assembly viewed along section 3-3 of FIG. 2.

With reference to FIGS. 2 and 3, a housing 70 of the ranging arm assembly 55 supports a motor 75 (e.g., electric motor, hydraulic motor, etc.) and a geartrain 80. The housing 70 includes an upper surface 82 and a lower surface 84 opposite the upper surface 82. The motor 75 and the geartrain 80 are positioned between the upper surface 82 and the lower surface 84. As best shown in FIG. 3, the motor 75 is oriented within the housing 70 such that a drive shaft of the motor 75 is parallel to the first pivot axis 25. Likewise, each gear 82 of the geartrain 80 is oriented within the housing 70 such that a rotational axis of each gear 82 is parallel to the first pivot axis 25. The motor 75 and the geartrain 80 are aligned to transmit torque along a longitudinal axis 85 of the housing 70 (e.g., in a direction perpendicular to the first axis 25). The motor 75 is powered by the power unit 30 to drive the geartrain 80, which in turn, is operable to drive a cutting drum 90 about a rotational axis 95. An outer surface of the cutting drum 90 includes a plurality of cutting bits (not shown) operable to engage a mine wall to cut material from the mine wall. The cutting drum 90 also includes an upper portion 102 positioned above the upper surface 82 of the housing 70 in a direction transverse to the longitudinal axis 85 of the housing 70 and a lower portion 104 positioned below the lower surface 84 of the housing 70 in a direction transverse to the longitudinal axis 85 of the housing 70.

With continued reference to FIGS. 2 and 3, the illustrated pitch adjustment system 60 includes a first member 100 coupled to the chassis mount 50 and a second member 105 coupled to the housing 70. The pitch adjustment system 60 enables the ranging arm assembly 55 to pivot relative to the chassis mount 50 about a pitch axis 110 (for example, in a direction perpendicular to the first pivot axis 25). The illustrated pitch axis 110 extends in a direction between the pivot axis 25 and the rotational axis 95. In some embodiments, the pitch axis 110 can intersect the pivot axis 25 and the rotational axis 95. Also, in some embodiments, the pitch axis 110 can extend through a portion of the motor 75 and/or a portion of the geartrain 80. In the illustrated embodiment, the pitch axis 110 is colinear with the longitudinal axis 85 of the ranging arm assembly 55. In other embodiments, the pitch axis 110 can be spaced from, but parallel to, the longitudinal axis 85. The illustrated first member 100 is formed as one piece with the chassis mount 50, and the second member 105 is fastened to the housing 70. In other embodiments, the first member 100 can be fastened to the chassis mount 50 and/or the second member 105 can be formed as one piece with the housing 70.

Figure 4:
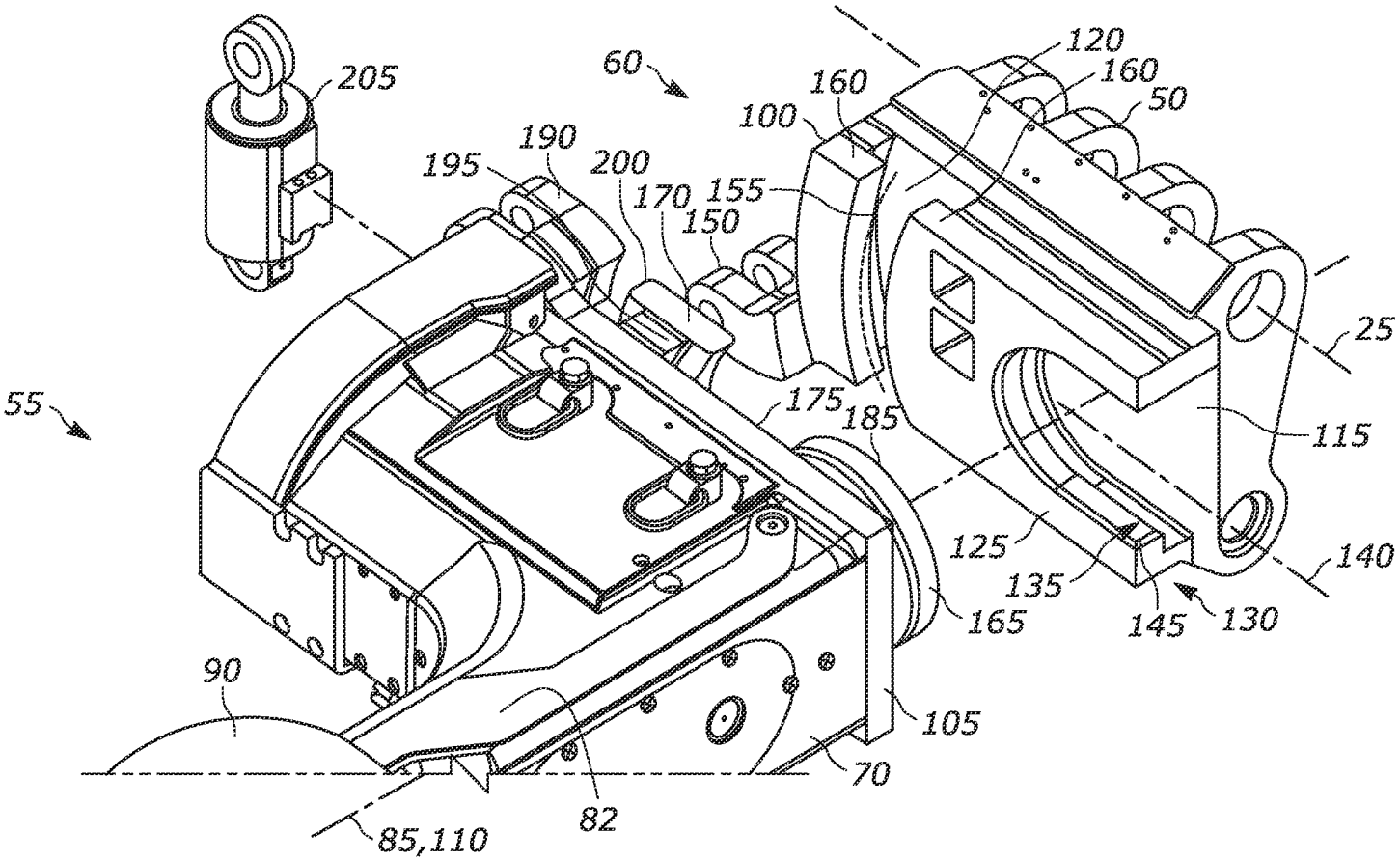
FIG. 4 is a first exploded view of a portion of the cutting assembly of FIG. 2.

As best shown in FIG. 4, the first member 100 includes a hub slot 115 and a support channel 120 formed in a first interfacing surface 125 of the first member 100. The hub slot 115 is spaced from the support channel 120 and includes a first opening 130 formed in a side of the first member 100 and a second opening 135 formed in the first interfacing surface 125. The hub slot 115 also includes a slot central axis 140 extending through the first opening 130 parallel with the first pivot axis 25. In other embodiments, the slot central axis 140 can be obliquely oriented relative to the first pivot axis 25. The illustrated first member 100 also includes a slot flange 145 defining the second opening 135. The pitch axis 110 extends through the second opening 135. The illustrated hub slot 115 includes a cross section (in a plane perpendicular to the pitch axis 110) that is generally U-shaped. In addition, the first member 100 includes a first actuator bracket 150 extending from a side of the first member 100 opposite the first opening 130.

With continued reference to FIG. 4, the illustrated support channel 120 extends through top and bottom sides of the first member 100 and defines a channel central axis 155. In particular, the channel central axis 155 includes a constant radius about the pitch axis 110. The support channel 120 also includes channel flanges 160 extending along the channel central axis 155. The support channel 120 includes a cross section (in a plane parallel to the pitch axis 110) that is generally T-shaped. In other embodiments, the support channel 120 can include other configurations (e.g., the channel 120 can generally include a L-shaped cross section).

Figure 5:
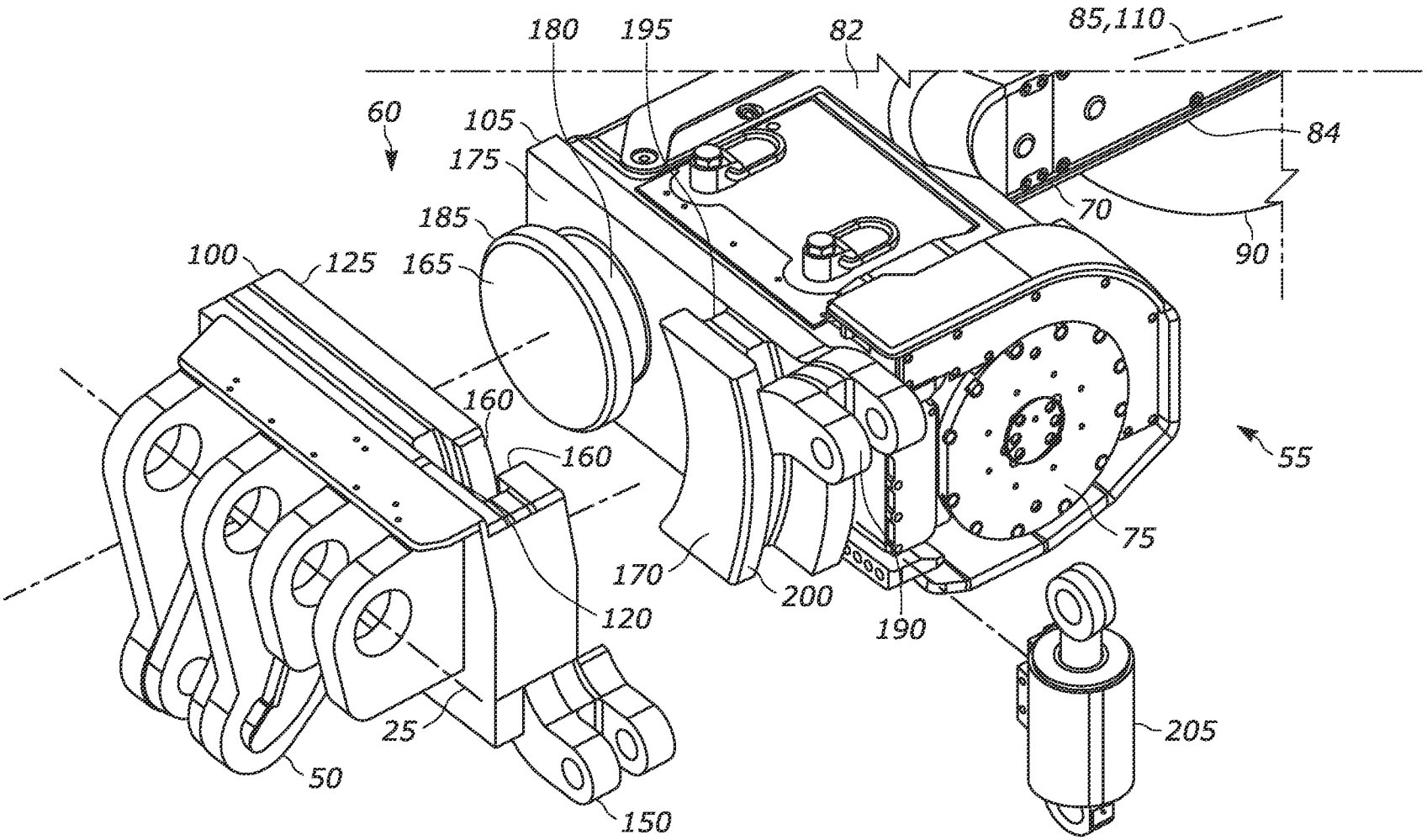
FIG. 5 is a second exploded view of a portion of the cutting assembly of FIG. 2.

As best shown in FIG. 5, the second member 105 includes a pivot hub 165 and a pivot support 170 extending from a second interfacing surface 175 of the second member 105. The illustrated pivot hub 165 is spaced from the pivot support 170 and includes a hub base 180 (e.g., a cylindrical base) extending from the second interfacing surface 175 and a hub protrusion 185 (e.g., a cylindrical protrusion) supported on an end of the hub base 180. The hub base 180 may have a smaller profile in a plane perpendicular to the pitch axis 110 than the hub protrusion 185. In the illustrated embodiment, the hub base 180 includes a diameter less than a diameter of the hub protrusion 185. In other embodiments, the pivot hub 165 can include other configurations (e.g., shaped as a frustoconical hub with the smaller portion of the frustoconical hub coupled to the second interfacing surface 175). The pitch axis 110 extends centrally through the pivot hub 165. The second member 105 also includes a second actuator bracket 190 extending from a side of the second member 105 opposite the pivot hub 165.

With continued reference to FIG. 5, the pivot support 170 includes a support base 195 extending from the second interfacing surface 175 and a support protrusion 200 extending from the support base 195. The support base 195 and the support protrusion 200 form a cross section of the pivot support 170 (in a plane parallel to the pitch axis 110) that is generally T-shaped. As such, the support base 195 includes a smaller profile in a plane parallel to the pitch axis 110 than the support protrusion 200. In other embodiments, the pivot support 170 can include other configurations (e.g., the pivot support 170 can generally include an L-shaped cross section). In addition, the illustrated pivot support 170 includes a central axis having the same curvature as the channel central axis 155 of the support channel 120.

Figure 6:
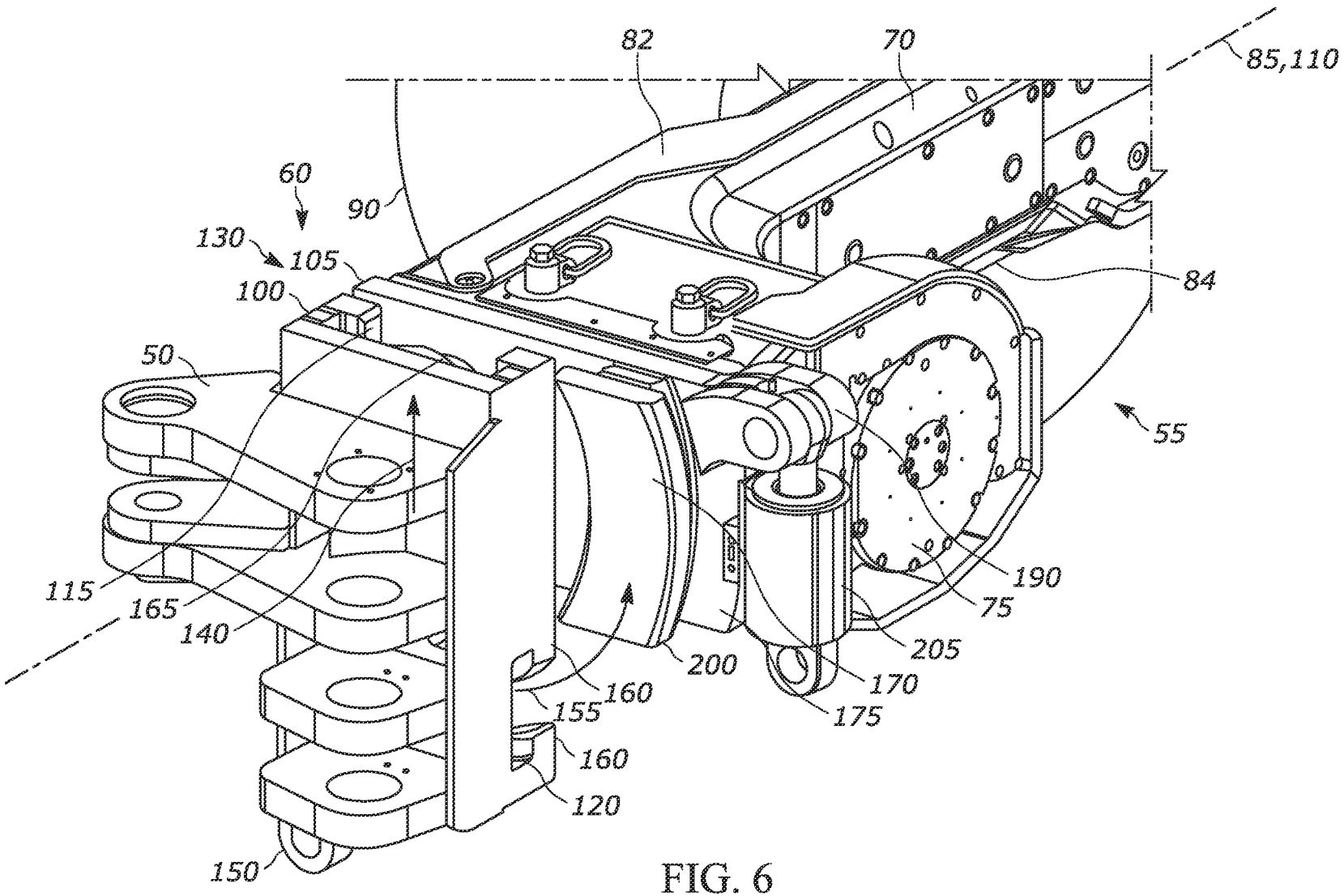
FIG. 6 is a perspective view of a portion of the cutting assembly of FIG. 2 illustrating assembly of the cutting assembly.

FIG. 6 illustrates partial assembly of the pitch adjustment system 60. The hub protrusion 185 of the pivot hub 165 is positioned in the hub slot 115 through the first opening 130 in a direction along the slot central axis 140. As a result, the hub base 180 is received within the second opening 135 of the hub slot 115. When the pivot hub 165 is received within the hub slot 115, the hub protrusion 185 engages the slot flange 145 to inhibit relative movement of the chassis mount 50 and the ranging arm assembly 55 in a direction along the pitch axis 110. However, the engagement between the pivot hub 165 and the hub slot 115 allows movement of the chassis mount 50 relative to the ranging arm assembly 55 about the pitch axis 110. Such movement allows the support channel 120 to receive the pivot support 170 along the channel central axis 155. When the pivot support 170 is received within the support channel 120, the support protrusion 200 engages the channel flanges 160 to also inhibit relative movement of the chassis mount 50 and the ranging arm assembly 55 in a direction along the pitch axis 110. In addition, the pivot hub 165 is inhibited from moving along the slot central axis 140 when the pivot support 170 is received within the support channel 120. However, the engagement between the pivot support 170 and the support channel 120 continues to allow movement of the chassis mount 50 relative to the ranging arm assembly 55 about the pitch axis 110.

As shown in FIGS. 3-5, the pivot hub 165 of the second member 105 is associated with the hub slot 115 of the first member 100 and the pivot support 170 of the second member 105 is associated with the support channel 120 of the first member 100. The illustrated pitch adjustment system 60 supports the cantilevered weight of the cutting drum 90 relative to the chassis 20. In particular, the engagement between the hub protrusion 185 and the slot flange 145 and the engagement between the support protrusion 200 and the channel flanges 160 support the weight of the ranging arm assembly 55 outboard of the pitch adjustment system 60 relative to the chassis 20. In other embodiments, the hub slot 115 and/or the support channel 120 can be formed on the second member 105, and/or the pivot hub 165 and/or the pivot support 170 can be formed on the first member 100. In further embodiments, the support channel 120 and the pivot support 170 can be omitted, and the pivot hub 165 and the hub slot 115 can be centrally located on the first and second members 100, 105. In this embodiment, an insert can be received within the hub slot 115 after the pivot hub 165 to be secured to the first member 100 to inhibit the pivot hub 165 from moving along the slot central axis 140.

Figure 7:
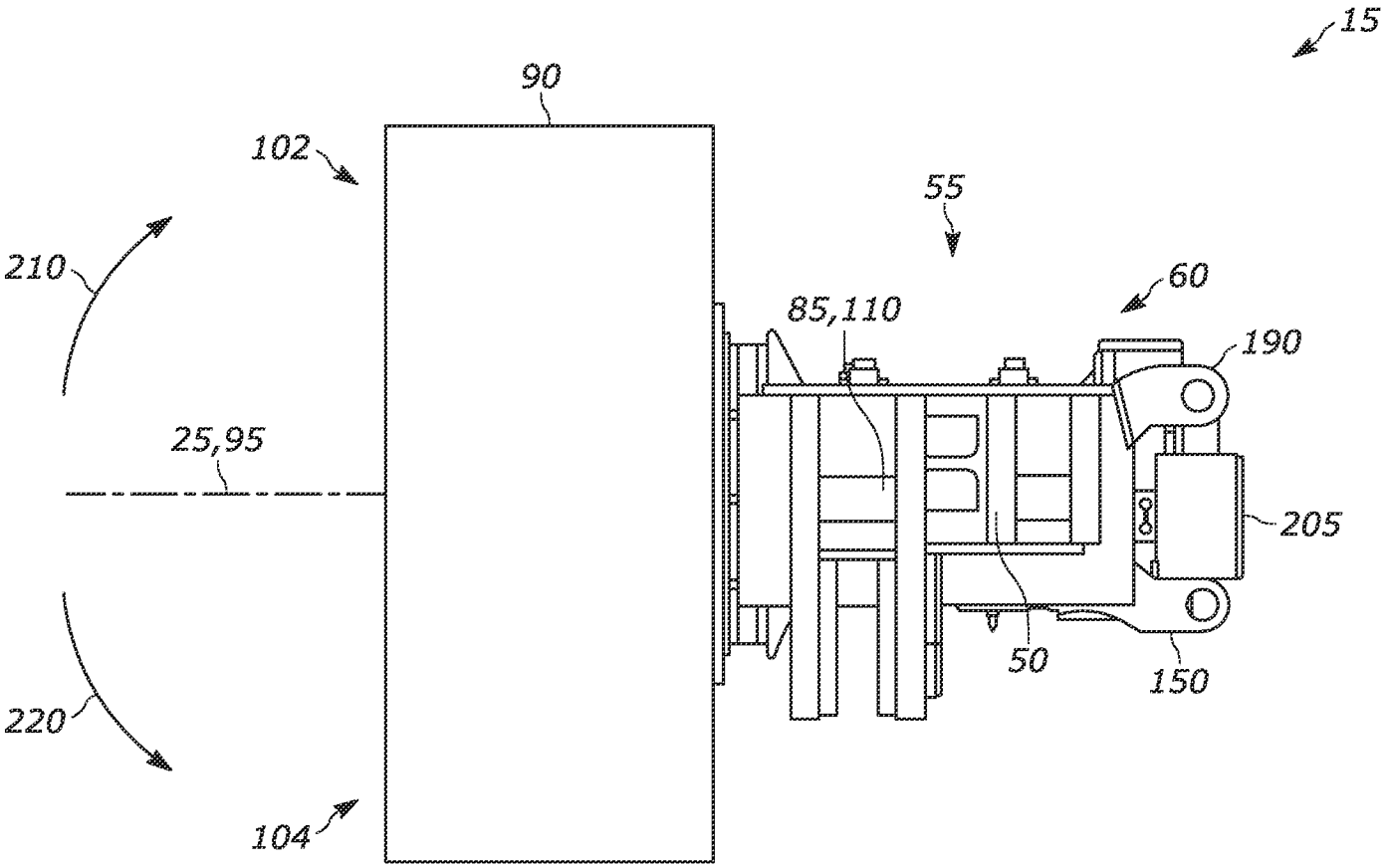
FIG. 7 is a side view of the cutting assembly of FIG. 2 illustrating the cutting assembly in a first orientation relative to a chassis of the mining machine.
Figure 8:
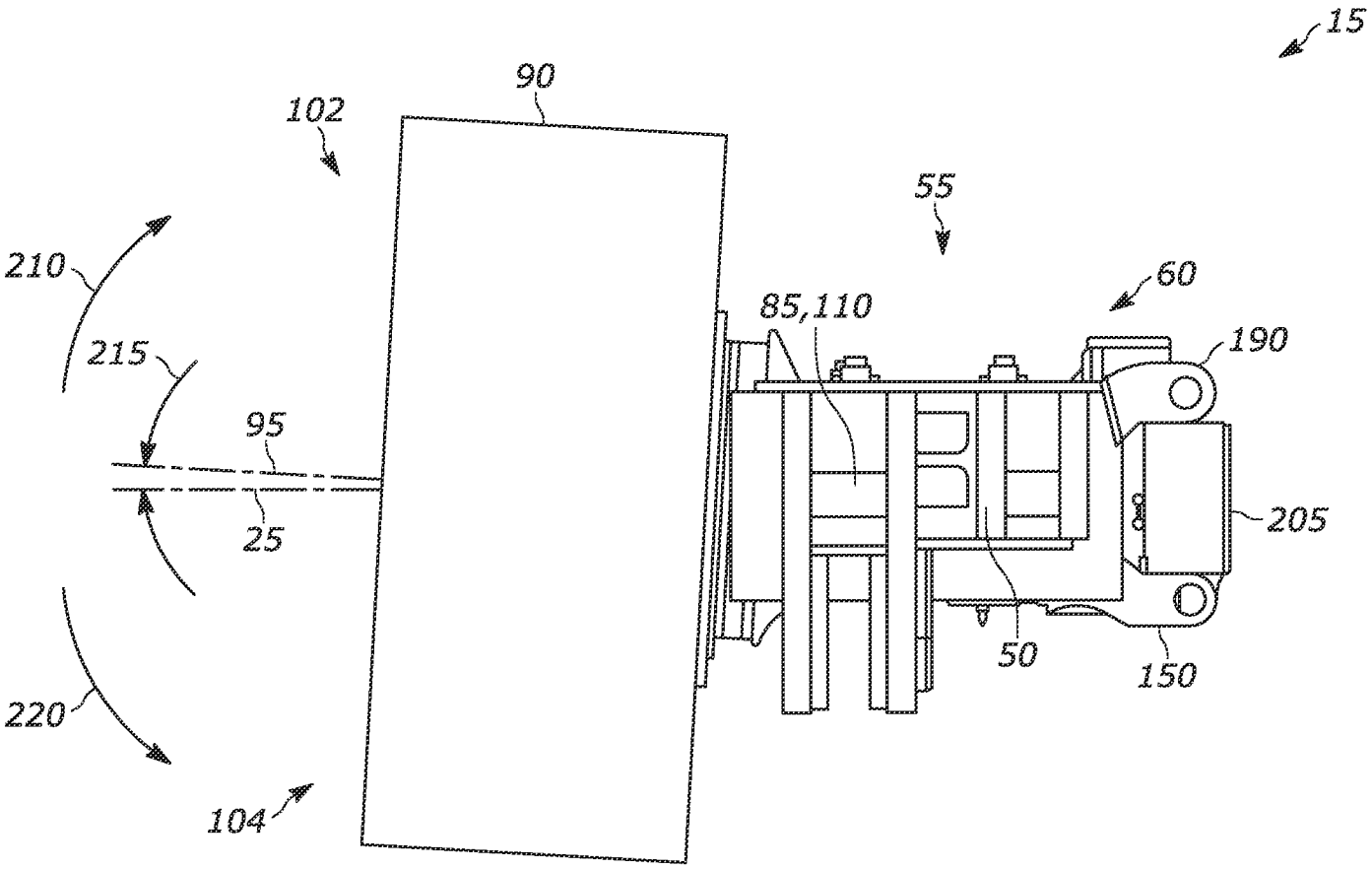
FIG. 8 is a side view of the cutting assembly of FIG. 2 illustrating the cutting assembly in a second orientation relative to the chassis of the mining machine.
Figure 9:
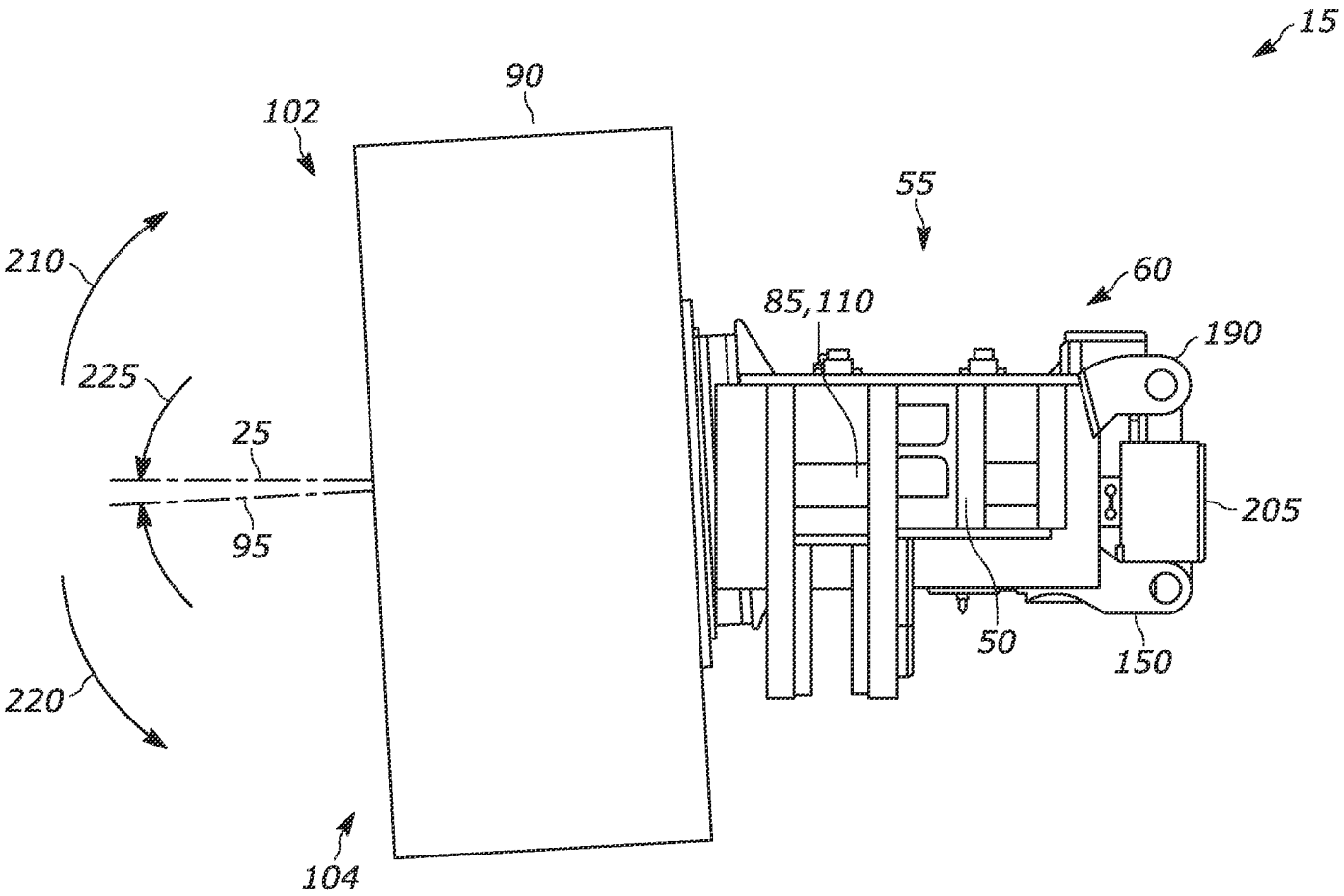
FIG. 9 is a side view of the cutting assembly of FIG. 2 illustrating the cutting assembly in a third orientation relative to the chassis of the mining machine.

In addition, an actuator 205 (e.g., a hydraulic cylinder) is coupled to the first and second actuator brackets 150, 190. The actuator 205 is operable by the power unit 30. With reference to FIGS. 7-9, the actuator 205 is operable to pivot the first and second members 100, 105 relative to each other to pivot the ranging arm assembly 55 about the pitch axis 110 relative to the chassis mount 50. Stated another way, the actuator 205 is operable to pivot the cutting drum 90 about the pitch axis 110. The illustrated cutting drum 90 includes three degrees of movement relative to the chassis 20 (movement about the first pivot axis 25, movement about the pitch axis 110, and movement about the rotational axis 95).

With reference to FIG. 7, the cutting drum 90 can be oriented in a first position such that the rotational axis 95 of the cutting drum 90 is parallel to the first pivot axis 25. Movement of the actuator 205 in a first direction (e.g., as the actuator 205 is retracted) moves the cutting drum 90 about the pitch axis 110 in a first, upward tilt direction 210. With reference to FIG. 8, the cutting drum 90 is positioned in a first maximum tilt position defined by a first angle 215 between the rotational axis 95 of the cutting drum 90 and the first pivot axis 25 when the actuator 205 is fully retracted. Conversely, movement of the actuator 205 in a second direction (e.g., as the actuator 205 is extended) moves the cutting drum 90 about the pitch axis 110 in a second, downward tilt direction 220. With reference to FIG. 9, the cutting drum 90 is positioned in a second maximum tilt position defined by a second angle 225 between the rotational axis 95 of the cutting drum 90 and the first pivot axis 25 when the actuator 205 is fully extended. In other embodiments, the cutting drum 90 can move in the first tilt direction 210 as the actuator 205 is extended, and the cutting drum 90 can move in the second tilt direction 220 as the actuator 205 is retracted.

In some embodiments, the first and second angles 215, 225 can be between about 1 degree and about 15 degrees, between about 1 degree and about 10 degrees, between about 1 degree and about 5 degrees, etc. In other embodiments, the first and second angles 215, 225 can be about 4 degrees. Also, the first angle 215 and the second angle 225 may be the same, or may be different from one another.

Figure 10:
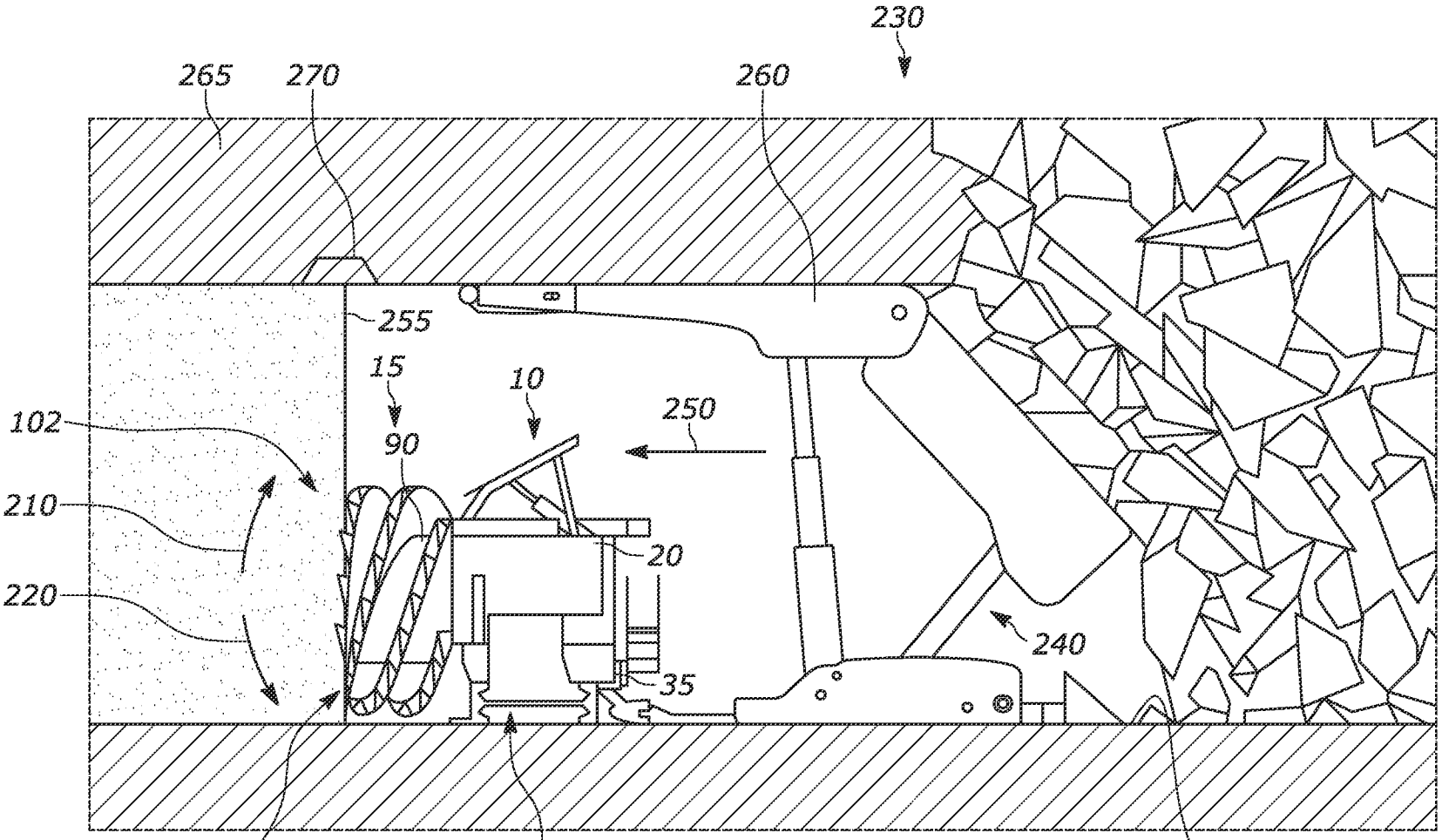
FIG. 10 is a side view of a longwall mining system including the mining machine of FIG. 1 during operation.

As shown in FIG. 10, a portion of a longwall mining system 230 is illustrated including the shearer 10, a conveyor assembly 235, and roof supports 240 that are supported on a mine floor 245. The illustrated roof supports 240 are operable to advance the shearer 10 and the conveyor assembly 235 in a forward direction 250 toward a mine wall 255. The forward direction 250 is perpendicular to the first direction 40 and the second direction 45 of the shearer 10. Each roof support 240 is positioned behind the conveyor assembly 235 (i.e., away from the mine face 255) and includes a shield 260 extending over the chassis 20 and the conveyor assembly 235 to engage a mine roof 265 opposite the mine floor 245.

In operation, the first and second cutting assemblies 15 are moved about their first axis 25 to position the cutting drums 90 of the assemblies 15 relative to the mine face 255. For example, the first cutting assembly 15 can be elevated to cut material (e.g., coal or other minerals) from an upper portion of the mine face 255 adjacent the roof 265, while the second cutting assembly 15 can be lowered to cut material from a lower portion of the mine face 255 adjacent the floor 245. Each cutting drum 90 is driven about its rotational axis 95 by its motor 75 and geartrain 80 to cut material from the mine face 255. While the first and second cutting assemblies 15 are cutting material from the mine face 255, the shearer 10 trams along the track 35 in the first direction 40 or the second direction 45. Accordingly, with each pass of the shearer 10 along the mine face 255 in the first direction 40 or the second direction 45, a section of material 270 is cut from the mine face 255.

The illustrated shearer 10 can adjust an orientation of each cutting drum 90 about its respective pitch axis 110 while the shearer 10 is moving in the first direction 40, the second direction 45, and/or the forward direction 250. Adjusting the orientation of each cutting drum 90 about its respective pitch axis 110 provides greater control of material being cut from the mine face 255. For example, the cutting assemblies 15 can shape the mine face 255 relative to the mine floor 245. In some situations, the mine floor 245 and the mine face 255 may not be perpendicular to each other as shown in FIG. 10. As such, the cutting drums 90 can independently move in the first or second tilt directions 210, 220 to ensure the mine face 255 is perpendicular to the forward direction 250 and/or the mine floor 245 as the shearer 10 moves in the first direction 40 or the second direction 45. In other words, the lower portion 104 of the cutting drum 90 moves toward the mining wall 255 (or further into the mining wall 255) and the upper portion 102 of the cutting drum 90 moves away from the mining wall 255 when the pitch adjustment system 60 moves the cutting drum 90 in the upward tilt direction 210. Conversely, the lower portion 104 of the cutting drum 90 moves away from the mining wall 255 and the upper portion 102 of the cutting drum 90 moves toward the mining wall 255 (or further into the mining wall 255) when the pitch adjustment system 60 moves the cutting drum 90 in the downward tilt direction 220.

Although certain aspects have been described in detail with reference to certain preferred embodiments, variations and modifications exist within the scope and spirit of one or more independent aspects as described. Various features and advantages of the disclosure are set forth in the following claims.

The invention claimed is:

1. A cutting assembly configured to be coupled to a chassis of a mining machine, the cutting assembly comprising:

a ranging arm configured to pivot about a pivot axis relative to the chassis;

a motor supported by the ranging arm for the motor to move with the ranging arm about the pivot axis;

a drum including a plurality of cutting picks, the drum supported by the ranging arm to be driven about a rotational axis by the motor; and a pitch adjustment actuator coupled to the ranging arm, the pitch adjustment actuator operable to move the drum about a pitch axis, the pitch axis extending in a direction between the pivot axis and the rotational axis.

2. The cutting assembly of claim 1, wherein the pitch axis extends through at least a portion of the ranging arm and intersects with the pivot axis and the rotational axis.

3. The cutting assembly of claim 2, wherein the pitch axis extends through the motor.

4. The cutting assembly of claim 3, further comprising a geartrain supported by the ranging arm, wherein the geartrain is coupled to the motor and the drum for the motor to drive the drum about the rotational axis, and wherein the pitch axis extends through at least a portion of the geartrain.

5. The cutting assembly of claim 1, wherein the pitch adjustment actuator includes a first member and a second member, wherein one of the first and second members includes a hub protrusion and the other one of the first and second members includes a hub slot, wherein the hub protrusion is received within the hub slot, and wherein the pitch axis extends through the hub protrusion and the hub slot.

6. The cutting assembly of claim 5, wherein one of the first and second members includes a pivot support protrusion and the other one of the first and second members includes a pivot support channel, and wherein the pivot support protrusion is received within the pivot support channel to maintain the hub protrusion within the hub slot.

7. The cutting assembly of claim 6, wherein the pitch adjustment actuator includes an actuator coupled between the first and second members, and wherein the actuator is operable to move the first and second members relative to each other about the pitch axis to move the drum about the pitch axis.

8. A cutting assembly configured to be coupled to a chassis of a mining machine, the mining machine configured to move in a direction relative to a mining wall, the cutting assembly comprising:

a ranging arm including an upper surface and a lower surface opposite the upper surface, the ranging arm configured to pivot about a pivot axis relative to the chassis;

a motor supported by the ranging arm;

a drum including a plurality of cutting picks, the drum including a first portion positioned above the upper surface of the ranging arm and a second portion positioned below the lower surface of the ranging arm, the drum supported by the ranging arm to be driven about a rotational axis by the motor; and a pitch adjustment actuator configured to be coupled between the ranging arm and the chassis, the pitch adjustment actuator configured to move the drum about a pitch axis such that the first portion of the drum moves toward the mining wall and the second portion of the drum moves away from the mining wall, the pitch adjustment actuator also configured to move the drum about the pitch axis such that the first portion of the drum moves away from the mining wall and the second portion of the drum moves toward the mining wall.

9. The cutting assembly of claim 8, wherein the pitch axis extends through the motor.

10. The cutting assembly of claim 9, further comprising a geartrain supported by the ranging arm, wherein the geartrain is coupled to the motor and the drum for the motor to drive the drum about the rotational axis, and wherein the pitch axis extends through at least a portion of the geartrain.

11. The cutting assembly of claim 8, wherein the pitch adjustment actuator includes a first member and a second member, wherein one of the first and second members includes a hub protrusion and the other one of the first and second members includes a hub slot, wherein the hub protrusion is received within the hub slot, and wherein the pitch axis extends through the hub protrusion and the hub slot.

12. The cutting assembly of claim 11, wherein one of the first and second members includes a pivot support protrusion and the other one of the first and second members includes a pivot support channel, and wherein the pivot support protrusion is received within the pivot support channel to maintain the hub protrusion within the hub slot.

13. The cutting assembly of claim 12, wherein the pitch adjustment actuator includes an actuator coupled between the first and second members, and wherein the actuator is operable to move the first and second members relative to each other about the pitch axis to move the drum about the pitch axis.

14. A mining machine comprising:

a chassis including a first end portion and a second end portion, the chassis configured to tram in a direction extending between the first end portion and the second end portion;

a first cutting assembly coupled to the first end portion of the chassis, the first cutting assembly including a first ranging arm pivotable about a first pivot axis relative to the chassis, a first motor supported by the first ranging arm for the first motor to move with the first ranging arm about the first pivot axis, a first drum including a plurality of first cutting picks, the first drum supported by the first ranging arm to be driven about a first rotational axis by the first motor, and a first pitch adjustment actuator coupled between the first ranging arm and the first end portion of the chassis, the first pitch adjustment actuator operable to move the first drum about a first pitch axis, the first pitch axis extending in a direction between the first pivot axis and the first rotational axis; and a second cutting assembly coupled to the second end portion of the chassis, the second cutting assembly including a second ranging arm pivotable about a second pivot axis relative to the chassis, a second motor supported by the second ranging arm for the second motor to move with the second ranging arm about the second pivot axis, a second drum including a plurality of second cutting picks, the second drum supported by the second ranging arm to be driven about a second rotational axis by the second motor, and a second pitch adjustment actuator coupled between the second ranging arm and the second end portion of the chassis, the second pitch adjustment actuator operable to move the second drum about a second pitch axis, the second pitch axis extending in a direction between the second pivot axis and the second rotational axis.

15. The mining machine of claim 14, wherein the first pitch adjustment actuator is positioned between the first end portion of the chassis and the first motor, and wherein the second pitch adjustment actuator is positioned between the second end portion of the chassis and the second motor.

16. The mining machine of claim 14, wherein the first pitch axis extends through at least a portion of the first ranging arm, and wherein the second pitch axis extends through at least a portion of the second ranging arm.

17. The mining machine of claim 16, wherein the first pitch axis extends through the first motor, and wherein the second pitch axis extends through the second motor.

18. The mining machine of claim 14, wherein the first pitch adjustment actuator includes a first member and a second member, wherein one of the first and second members includes a hub protrusion and the other one of the first and second members includes a hub slot, wherein the hub protrusion is received within the hub slot, and wherein the first pitch axis extends through the hub protrusion and the hub slot.

19. The mining machine of claim 18, wherein one of the first and second members includes a pivot support protrusion and the other one of the first and second members includes a pivot support channel, and wherein the pivot support protrusion is received within the pivot support channel to maintain the hub protrusion within the hub slot.

20. The mining machine of claim 19, wherein the first pitch adjustment actuator includes an actuator coupled between the first and second members, and wherein the actuator is operable to move the first and second members relative to each other about the first pitch axis to move the first drum about the first pitch axis.

* * * * *